US011419425B2

(12) United States Patent
Ega et al.

(10) Patent No.: US 11,419,425 B2
(45) Date of Patent: Aug. 23, 2022

(54) POSTURE ADAPTIVE WORK CHAIR

(71) Applicant: GODREJ & BOYCE MFG. CO. LTD., Mumbai (IN)

(72) Inventors: Venkateshwarlu Ega, Mumbai (IN); Nirav Ileshkumar Shah, Mumbai (IN); Nitesh Yashwant Chalke, Mumbai (IN)

(73) Assignee: GODREJ & BOYCE MFG. CO. LTD., Mumbai (IN)

( * ) Notice: Subject to any disclaimer, the term of this patent is extended or adjusted under 35 U.S.C. 154(b) by 0 days.

(21) Appl. No.: 16/753,305

(22) PCT Filed: Oct. 4, 2018

(86) PCT No.: PCT/IB2018/057715

§ 371 (c)(1),
(2) Date: Apr. 2, 2020

(87) PCT Pub. No.: WO2019/069263

PCT Pub. Date: Apr. 11, 2019

(65) Prior Publication Data

US 2020/0245768 A1 Aug. 6, 2020

(30) Foreign Application Priority Data

Oct. 5, 2017 (IN) ..... 201721035341

(51) Int. Cl.

| | |
|---|---|
| ***A47C 1/032*** | (2006.01) |
| ***A47C 7/44*** | (2006.01) |
| ***A47C 7/54*** | (2006.01) |
| ***A47C 3/30*** | (2006.01) |
| ***A47C 3/40*** | (2006.01) |
| ***A47C 7/00*** | (2006.01) |

(52) U.S. Cl.

CPC ..... *A47C 7/44* (2013.01); *A47C 3/30* (2013.01); *A47C 3/40* (2013.01); *A47C 7/004* (2013.01); *A47C 7/006* (2013.01); *A47C 7/541* (2018.08)

(58) Field of Classification Search

CPC .. A47C 3/30; A47C 3/40; A47C 7/004; A47C 7/006; A47C 7/44; A47C 7/541

USPC ..... 297/285–309, 446.1, 447.3

See application file for complete search history.

(56) References Cited

U.S. PATENT DOCUMENTS 1,941,340 A * 12/1933 Dellert ..... A47C 3/023 297/239

1,950,226 A * 3/1934 Cable ..... A47C 3/023 297/287

(Continued)

FOREIGN PATENT DOCUMENTS

JP 2000-342377 A 12/2000

*Primary Examiner* — Rodney B White

(74) *Attorney, Agent, or Firm* — BakerHostetler

(57) ABSTRACT

The present application relates to a chair which adapts to dynamic body postures of a user. The posture adaptive work chair includes a seat sub-assembly having a front edge and a seat base sub-assembly; a pair of spine members cantilevered from the font edge of the seat sub-assembly; a back sub-assembly supported by the pair of spine members, and configured to flex in multiple axes based on a direction of load applied by a user; and a tilt limit lever movably coupled to the seat base sub-assembly and configured to enable tilting of the back-sub assembly to a plurality of tilt positions.

12 Claims, 9 Drawing Sheets

(56) References Cited

U.S. PATENT DOCUMENTS 1,978,024 A * 10/1934 Lorens ..... G01S 1/72 297/288
2,006,421 A * 7/1935 Trainor ..... A47C 3/021 297/287
2,046,715 A * 7/1936 Zerbee ..... A47C 3/021 297/411.42
2,063,781 A * 12/1936 Ball ..... A47C 3/021 297/286
2,069,456 A * 2/1937 Mcgowen ..... A47C 3/021 297/287
2,080,607 A * 5/1937 Galante ..... A47C 3/021 297/287
2,135,586 A * 11/1938 Lorenz ..... A47C 3/021 297/287
2,135,833 A * 11/1938 Oermann ..... A47C 3/021 297/287
2,141,475 A * 12/1938 Johannsen ..... A47C 4/20 297/51
2,246,057 A * 6/1941 Michaelis ..... A47C 5/04 297/287
2,283,755 A * 5/1942 Mies ..... A47C 3/021 248/628
2,303,039 A * 11/1942 Gilklson ..... A47C 3/021 297/411.42
2,564,915 A * 8/1951 Nelson ..... A47C 5/10 297/287
2,638,149 A * 5/1953 Janosek ..... A47C 4/02 297/411.42
2,913,038 A * 11/1959 Mcderby ..... A47C 1/16 248/628
2,981,315 A * 4/1961 Schaffer ..... A47C 3/023 297/287
3,120,407 A * 2/1964 Propst ..... A47C 7/32 297/452.19
4,290,645 A * 9/1981 Glickman ..... A47C 3/04 297/239
4,418,958 A * 12/1983 Watkin ..... A47C 7/029 297/452.15
4,522,444 A * 6/1985 Pollock ..... A47C 3/04 297/239
4,618,185 A * 10/1986 Kaufman ..... A47C 1/029 297/285
4,786,105 A * 11/1988 Sheehan ..... A47C 3/029 297/271.6
4,786,106 A * 11/1988 Bottemiller ..... A47C 7/444 297/265.1
4,790,596 A * 12/1988 Shifferaw ..... A47C 3/021 248/628
4,889,385 A * 12/1989 Chadwick ..... A47C 3/026 297/300.1
4,911,500 A * 3/1990 Saiger ..... A47C 3/021 297/287
4,938,530 A * 7/1990 Snyder ..... A47C 3/023 297/287
4,979,778 A * 12/1990 Shields ..... A47C 1/03255 297/300.2
5,249,839 A * 10/1993 Faiks ..... A47C 1/03255 297/284.4
5,314,240 A * 5/1994 Ishi ..... A47C 7/405 297/452.15
5,328,242 A 7/1994 Steffens et al.
5,486,035 A * 1/1996 Koepke ..... A47C 1/03255 297/300.1
5,599,064 A * 2/1997 Vanderminden, Sr. ..... A47C 3/0252 297/344.21
5,695,244 A * 12/1997 Gillern ..... A47C 3/029 297/271.6
5,765,804 A * 6/1998 Stumpf ..... A47C 1/03238 248/631
5,765,914 A * 6/1998 Britain ..... A47C 1/03294 297/300.4
5,775,774 A * 7/1998 Okano ..... A47C 1/03255 297/300.2
5,895,095 A 4/1999 Chen
5,931,531 A * 8/1999 Assmann ..... A47C 1/03255 297/316
5,964,503 A * 10/1999 Inoue ..... A47C 1/03274 297/300.4
6,003,948 A * 12/1999 Holbrook ..... A47C 7/70 297/440.15
6,102,477 A * 8/2000 Kurtz ..... A47C 3/03 297/301.7
6,199,952 B1 * 3/2001 Davis ..... A47C 3/30 297/300.4
6,511,128 B2 * 1/2003 Piretti ..... A47C 7/402 297/300.4
6,568,760 B2 * 5/2003 Davis ..... A47C 1/03255 297/300.1
6,616,231 B2 * 9/2003 Koepke ..... A47C 1/026 297/300.7
6,644,741 B2 * 11/2003 Nelson ..... A47C 1/03255 297/300.1
6,669,292 B2 * 12/2003 Koepke ..... A47C 1/03255 297/300.1
6,685,267 B1 * 2/2004 Johnson ..... A47C 1/023 297/300.1
6,896,328 B2 * 5/2005 Goodworth ..... A47C 3/026 297/297
6,913,317 B2 * 7/2005 Vanderminden ..... A47C 3/0252 297/344.24
6,935,689 B2 * 8/2005 Horiki ..... A47C 1/03266 297/300.5
6,945,602 B2 * 9/2005 Fookes ..... A47C 1/03277 297/300.4
7,159,943 B2 * 1/2007 Costaglia ..... A47C 1/03255 297/301.4
7,226,127 B1 * 6/2007 Yevko ..... A47C 7/44 297/284.1
7,434,879 B2 * 10/2008 Ueda ..... A47C 7/4454 297/296
7,503,626 B2 * 3/2009 Maier ..... A47C 1/03205 297/300.2
7,665,805 B2 * 2/2010 Ueda ..... A47C 1/03255 297/301.6
7,712,833 B2 * 5/2010 Ueda ..... A47C 1/03261 297/296
7,717,513 B2 * 5/2010 Ueda ..... A47C 7/444 297/300.2
7,775,590 B2 * 8/2010 Shen ..... A47C 4/028 297/287
7,837,265 B2 * 11/2010 Machael ..... A47C 7/46 297/300.2
7,841,664 B2 * 11/2010 Holdredge ..... A47C 1/032 297/300.2
7,862,120 B2 * 1/2011 Ueda ..... A47C 1/03261 297/297
7,926,879 B2 * 4/2011 Schmitz ..... A47C 3/12 297/452.19
7,997,651 B2 * 8/2011 Shen ..... A47C 4/02 297/287
8,061,775 B2 * 11/2011 Diffrient ..... A47C 1/03255 297/300.1
8,083,288 B1 * 12/2011 Warncke ..... A47C 4/02 297/134
8,414,073 B2 * 4/2013 Schmitz ..... A47C 1/03288 297/321
8,556,345 B2 * 10/2013 Huang ..... A47C 7/405 297/300.5
8,585,136 B2 * 11/2013 Warncke ..... A47C 4/02 297/134
8,622,473 B2 * 1/2014 Walsh ..... A47C 3/021 297/287
8,777,305 B1 * 7/2014 Jannetides ..... A47C 13/00 297/118
8,820,835 B2 * 9/2014 Minino ..... A47C 7/44 297/296

(56) References Cited

U.S. PATENT DOCUMENTS 8,882,089 B2 * 11/2014 Weisbeck ..... F16F 1/025 267/140.11
8,888,182 B2 * 11/2014 Ivicevic ..... A47C 1/023 297/294
8,960,787 B2 * 2/2015 Warncke ..... A47C 3/20 297/134
8,991,924 B2 * 3/2015 Piretti ..... A47C 7/445 297/285
8,998,322 B2 * 4/2015 Horiki ..... A47C 1/03266 297/300.1
9,198,514 B2 * 12/2015 Machael ..... A47C 1/03272
9,237,811 B1 * 1/2016 Cho ..... A47C 7/462
9,370,249 B2 * 6/2016 Warncke ..... A47C 3/20
9,414,684 B2 * 8/2016 Park ..... A47C 1/03277
9,504,331 B2 * 11/2016 Machael ..... A47C 1/03261
9,560,917 B2 * 2/2017 Roslund, Jr. ..... A47C 7/445
9,578,968 B2 * 2/2017 Masunaga ..... A47C 7/44
9,833,075 B2 * 12/2017 Unwalla ..... A47C 1/03255
9,883,746 B2 * 2/2018 Piretti ..... A47C 1/03277
10,016,061 B2 * 7/2018 Brueske ..... A47C 7/445
10,021,984 B2 * 7/2018 Ludwig ..... A47C 7/445
10,058,180 B2 * 8/2018 Desanta ..... A47C 1/032
10,194,750 B2 * 2/2019 Ludwig ..... A47C 3/20
10,383,448 B1 * 8/2019 VerBeek ..... A47C 1/03255
10,477,973 B2 * 11/2019 Gerbino ..... A47C 7/54
10,595,636 B2 * 3/2020 Jin ..... A47C 7/282
10,820,703 B2 * 11/2020 Maier ..... A47C 1/03277
10,820,706 B2 * 11/2020 Schmitz ..... A47C 7/025
10,842,272 B2 * 11/2020 Costaglia ..... A47C 1/024
2002/0005658 A1 * 1/2002 Piretti ..... A47C 7/444 297/302.3
2002/0190553 A1 * 12/2002 Koepke ..... A47C 7/46 297/300.2
2002/0190557 A1 12/2002 Koepke et al.
2004/0183350 A1 * 9/2004 Schmitz ..... A47C 1/03255 297/301.1
2006/0006715 A1 * 1/2006 Chadwick ..... A47C 7/282 297/300.4
2006/0033369 A1 * 2/2006 Eysing ..... B60N 2/66 297/284.4
2006/0103208 A1 * 5/2006 Schmitz ..... A47C 1/03266 297/316
2006/0181128 A1 * 8/2006 Takeuchi ..... A47C 7/441 297/301.4
2007/0108821 A1 * 5/2007 Ueda ..... A47C 1/03255 297/301.1
2007/0290537 A1 * 12/2007 Lin ..... A47C 1/03294 297/300.2
2008/0217977 A1 * 9/2008 Aldrich ..... A47C 7/40 297/284.3
2008/0272636 A1 * 11/2008 Machael ..... A47C 7/14 297/284.4
2008/0290712 A1 * 11/2008 Parker ..... A47C 7/14 297/354.11
2009/0102268 A1 * 4/2009 Schmitz ..... A47C 7/44 297/452.19
2009/0127905 A1 * 5/2009 Schmitz ..... A47C 1/03255 297/284.4
2009/0261644 A1 * 10/2009 Piretti ..... A47C 7/282 297/344.12
2010/0187884 A1 * 7/2010 Golynsky ..... A47C 7/445 297/301.1
2010/0289308 A1 * 11/2010 Schmitz ..... A47C 1/03288 297/300.2
2012/0007400 A1 * 1/2012 Behar ..... A47C 7/462 297/284.4
2012/0025574 A1 * 2/2012 Wilkinson ..... A47C 7/282 297/300.1
2012/0205952 A1 * 8/2012 Takeuchi ..... A47C 1/03272 297/300.1
2012/0228911 A1 * 9/2012 Piretti ..... A47C 7/445 297/285
2013/0241253 A1 * 9/2013 Harrison ..... A47C 7/14 297/258.1
2014/0077548 A1 * 3/2014 Peterson ..... A47C 3/00 297/284.4
2014/0077551 A1 * 3/2014 Battey ..... A47C 31/023 297/300.1
2014/0110983 A1 * 4/2014 Sander ..... A47C 7/004 297/284.1
2015/0102648 A1 4/2015 Park et al.
2016/0029801 A1 * 2/2016 Potrykus ..... A47C 7/44 297/285
2018/0352961 A1 * 12/2018 Deevers ..... B29C 70/88
2019/0223598 A1 * 7/2019 Jones ..... A47C 1/03272
2019/0365108 A1 * 12/2019 Deevers ..... A47C 7/541
2020/0000231 A1 * 1/2020 Schuppler ..... A47C 7/004
2021/0022508 A1 * 1/2021 Frankel ..... A47C 3/029
2021/0204699 A1 * 7/2021 Deevers ..... A47C 1/03255

* cited by examiner

POSTURE ADAPTIVE WORK CHAIR

CROSS-REFERENCE TO RELATED APPLICATIONS

This application is a National Stage of International patent application PCT/IB2018/057715, filed on Oct. 4, 2018, which claims priority to foreign Indian patent application No. IN 201721035341, filed on Oct. 5, 2017, the disclosures of which are incorporated by reference in their entirety.

TECHNICAL FIELD

The present subject matter generally relates to a chair, and more particularly, relates to a work chair which adapts to dynamic body postures of a user.

BACKGROUND

The modern workplace with increased use of network connectivity is reducing the need for people to move around in office for communication purpose. The intensely competitive nature of today's work culture has made tight deadlines and targets as innate part of long working schedule for most users, forcing them to remain seated for long hours. Further, even at home and in normal daily routine, due to increased use of technology and internet based social networking people tend to remain seated for long duration.

Ergonomic field studies indicate that static postures are associated with increasing number of health concerns. Static postures place a strain on the body, leading to fatigue and even spinal injuries over a period of time. No matter how comfortable is a chair, static seated postures can cause musculo-skeletal injuries and pain even after regular exercise. Furniture that would encourage frequent change in posture or help the users to be more active can prevent these risks associated with static positions adopted at work.

Hon (HNI group) has introduced a task/workstation chair comprising a seat and a back which can flex in multiple axes for allowing change in posture and providing support simultaneously. However, the back is connected with the seat towards its central axis and enables the multiple axes flexing only through a short distance from central pivot point. Hence, said task/workstation chair is neither very comfortable nor helps in dynamic body movements effectively due to its limited flex capabilities. Teknion, a U.S. based company introduced a multipurpose chair comprising an integrated seat and back, wherein the back provides flexing motion. However, Teknion's multipurpose chair lack flexibility, does not support the posture well and is not very efficient in terms of preventing risks associated with static positions of a user.

Hence, there is a need identified for a chair which helps in efficient interaction between the user and surrounding elements with ease and comfort. Further, there is a need for a chair that assists dynamic body movements and supports body posture changes, minimizes the risks associated with static body postures during long duration sitting and overcomes aforementioned as well as other challenges in relation with sitting postures.

SUMMARY

The present subject matter relates to a chair which adapts to dynamic body postures of a user.

It is an object of the present subject matter to provide a chair designed to intuitively adapt to users' posture changes.

It is another object of the present subject matter to encourage users to be playfully active while sitting.

It is yet another object of the present subject matter to keep users' body alert thereby bringing focus at work and better productivity.

It is yet another object of the present subject matter to provide a chair having synchronous easy flex system enabling dynamic body movements in sitting condition.

It is yet another object of the present subject matter to provide a chair, wherein the seat and back are firmly connected to the base frame and are cantilevered in such a way that it gives a multi-dimensional movement possibility just with a simple lean on the sides or back, without need for complex manual adjustment.

It is yet another object of the present subject matter to provide a back tilt with variable limit adjustment with different positions based on nature of activity performed.

It is yet another object of the present subject matter to provide a chair comprising a knee point cantilevered seat and back frame which is appropriate for use in workplaces and homes.

BRIEF DESCRIPTION OF DRAWINGS

These and other features, aspects, and advantages of the present invention will become better understood when the following detailed description is read with reference to the accompanying drawings in which like characters represent like components throughout the drawings, wherein.

DETAILED DESCRIPTION

Figure 1:
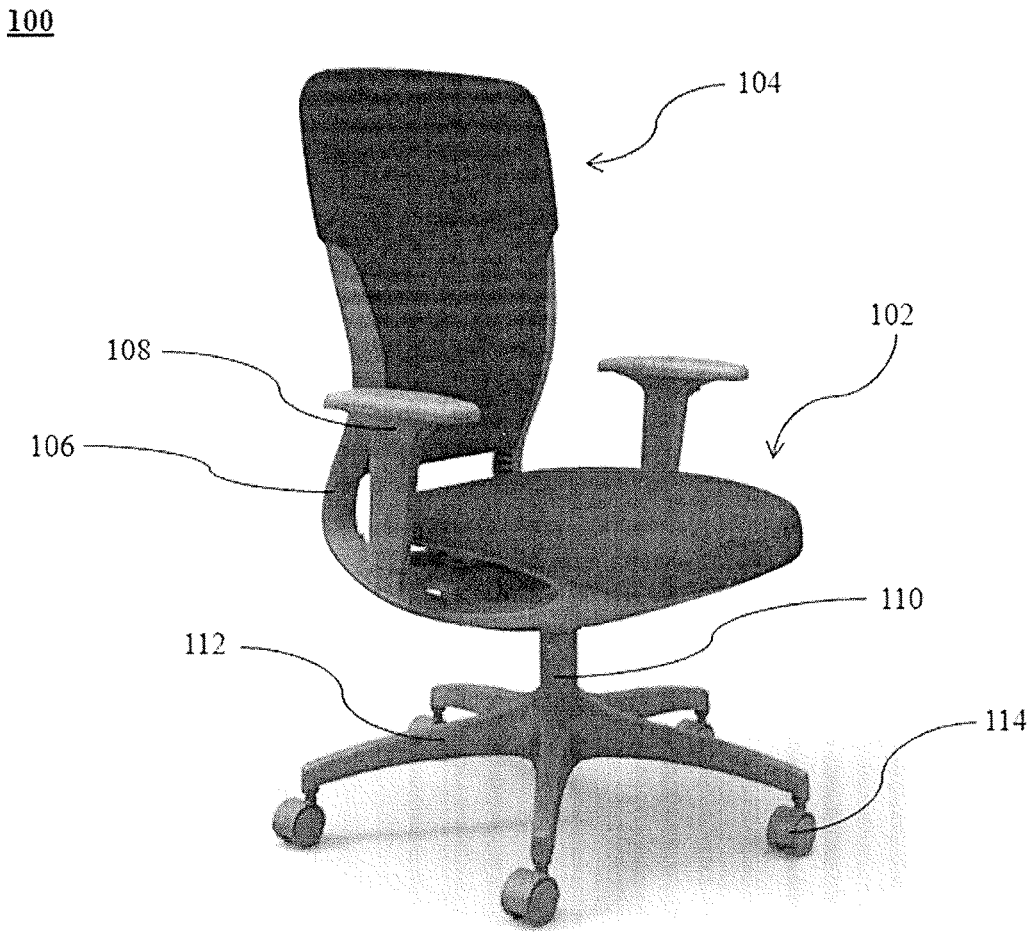
FIG. 1 illustrates a perspective view of a chair in accordance with an embodiment of the present subject matter.

The embodiments of the present subject matter are described in detail with reference to the accompanying drawings. However, the present subject matter is not limited to these embodiments which are only provided to explain more clearly the present subject matter to the ordinarily skilled in the art of the present disclosure. In the accompanying drawings, like reference numerals are used to indicate like components.

Described herein is a work chair, comprising a pedestal base member, a seat sub-assembly comprising a front edge and base sub-assembly, a back sub-assembly and an adjustable armrest sub-assembly. The back sub-assembly is supported by two spine members which are cantilevered from the front edge of the seat sub-assembly. The front edge can be defined as the portion where knees bend in sitting position. The back sub-assembly flexes in multiple axes as result of direction of load applied by a user's back on the work chair through the large cantilever formed by the spine members attached firmly at the front edge. For example, if the force applied on the back of the chair is acentric the flex will be also be acentric resulting in a 3 dimensional back movement based on the direction of load applied and following the posture adopted by the user. The spine members comprise of a combination of C-type and V-Type sections having continuous rib with cut-out in certain locations flexes through its geometry and plastic material properties. The two spine members are connected also near the rear part of the seat through a spine connector aiding in structural stability and being integral part of the tilt limiting feature. In an embodiment, the spine members are made up of Glass filled Poly-Amide. However, the aforementioned material is exemplary and not limiting in any way. It is clear to person skilled in the art that the spine members may comprise of any other suitable material showing similar properties. The seat sub-assembly comprising a seat base sub-assembly and is cantilevered from the front edge enabling a smooth landing while sitting and providing with synchronous flexing movement with the back sub-assembly during posture changes. Further, flexing of the back sub-assembly can be restricted as per user's requirement at multiple positions through a tilt limiter lever adjustment mounted within the seat base sub-assembly. For example, the tilt limit lever can be operated to allow the flexing/reclining of the back sub-assembly in three different positions. Hereinafter, various modes of carrying out the aforementioned invention have been discussed with the help of illustrations.

FIG. 1 illustrates a perspective view of a main chair 100 in accordance with an embodiment of the present subject matter. The main chair 100 comprises a seat sub-assembly 102 comprising a front edge 138 and base sub-assembly 124, a back sub-assembly 104, adjustable armrest sub-assembly 108 and pedestal base member 112. The back sub-assembly 104 is supported by two spine members 106 which are cantilevered from a front edge 124 of the seat sub-assembly 102. Further, the main chair 100 includes a plurality of components including but not limiting to two adjustable armrest sub-assemblies 108, a telescopic gas-lift cylinder 110 and a pedestal base member 112. The adjustable armrest sub-assembly 108 is provided on two laterally opposite sides of the seat sub-assembly 102 and can be used by a user to place arms on them in sitting position. The telescopic gas-lift cylinder 110 is fixedly attached between the pedestal base member 112 and the seat sub-assembly 102. Further, the telescopic gas-lift cylinder 110 is actuated longitudinally between the central axes of the pedestal base member 112 and the seat sub-assembly 102 respectively to adjust seat height of the work chair. The pedestal base member 112 is provided with a plurality of castors 114 for ease of displacement of the main chair 100 from one place to another.

Figure 2:
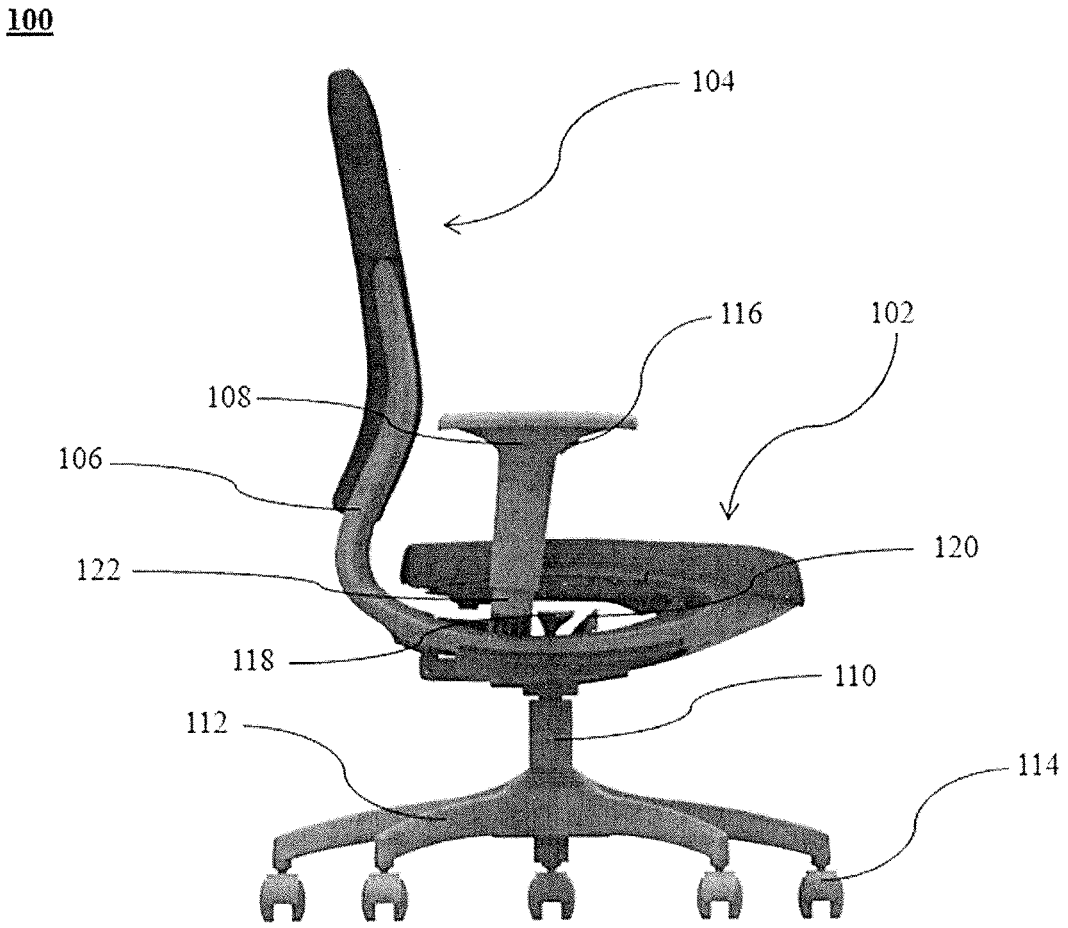
FIG. 2 illustrates a side view of a chair in accordance with an embodiment of the present subject matter.

FIG. 2 illustrates a side view of the main chair 100 in accordance with an embodiment of the present subject matter. The main chair 100 comprises a plurality of adjustment features, for instance, a push button 116, a seat height adjustment lever 118 and a tilt limit lever 120. The push button 116 is provided to adjust height of the adjustable armrest sub-assembly 108 in longitudinal direction with a series of intermediate stopper positions starting from a bottom end 122 of the adjustable armrest sub-assembly 108. The seat height adjustment lever 118 is provided for adjusting height of the seat sub-assembly 102 from the pedestal base member 112 through actuation of the telescopic gas-lift cylinder 110. The height of the seat sub-assembly 102 is adjusted by operating the telescopic gas-lift cylinder 110 through the seat height adjustment lever 118.

Figure 3A:
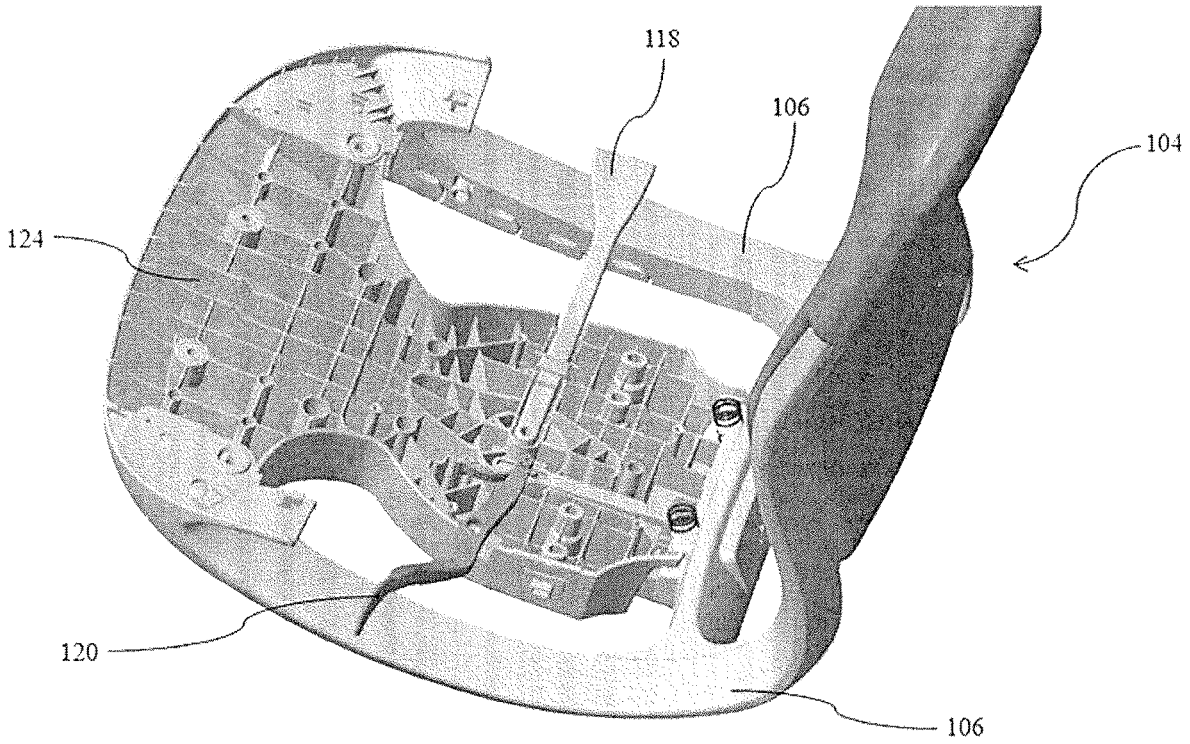
FIGS. 3*a* and 3*b* illustrate perspective views of an upholstered back sub-assembly with spine members and seat base sub-assembly in accordance with an embodiment of the present subject matter.
Figure 3B:
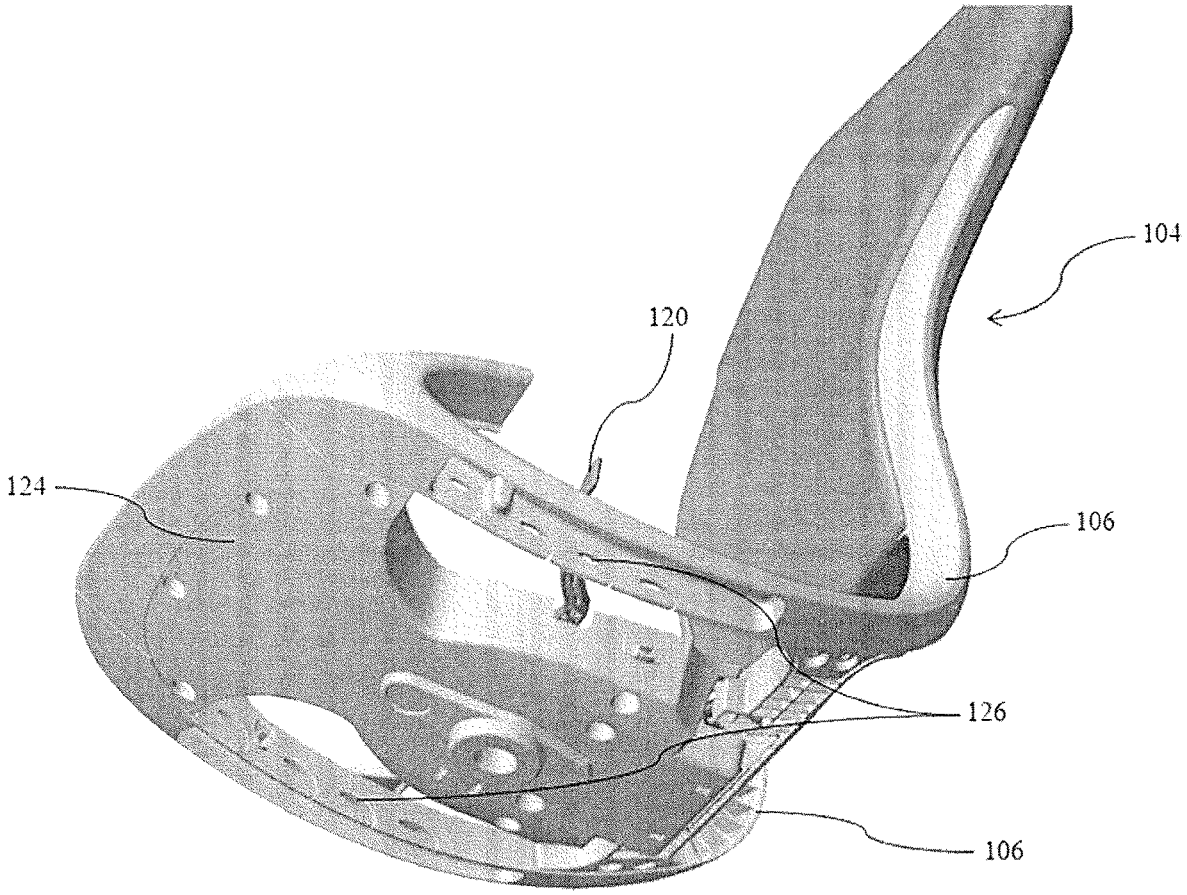
Figure 4A:
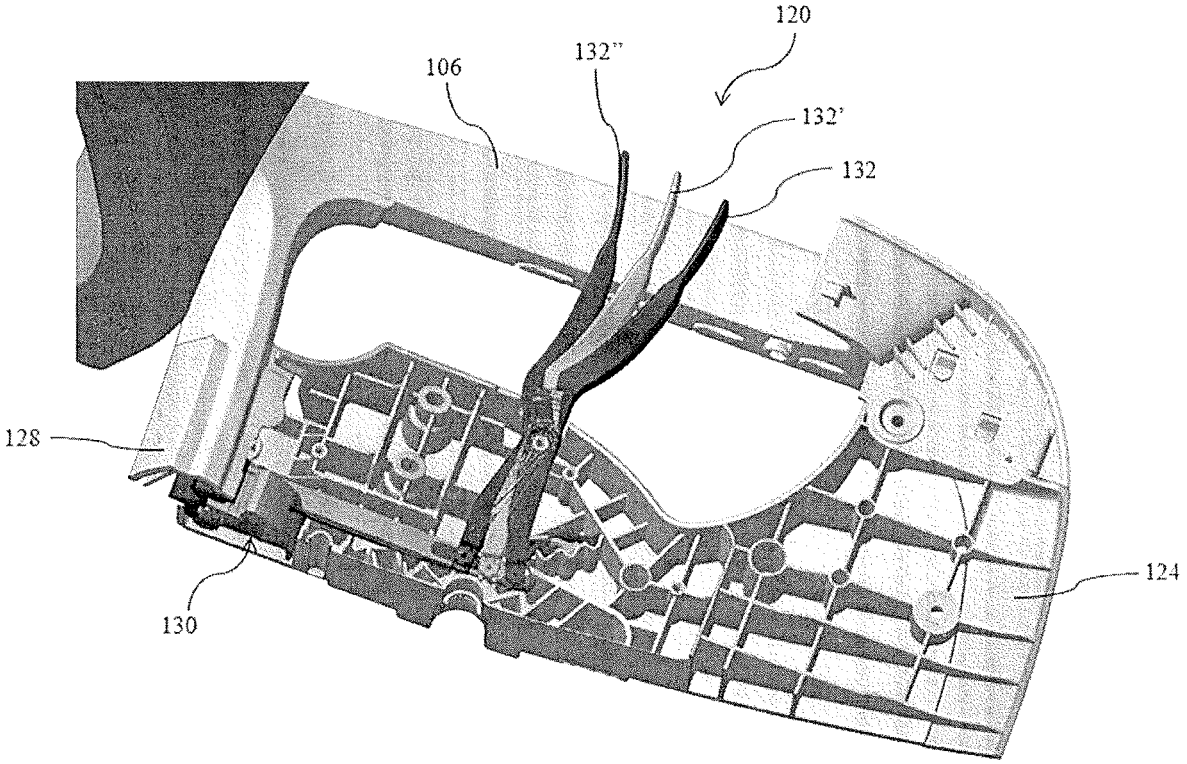
FIGS. 4*a*, 4*b*, 4*c* and 4*d* illustrate structure and operation of a tilt limiter of the chair in accordance with an embodiment of the present subject matter.
Figure 4B:
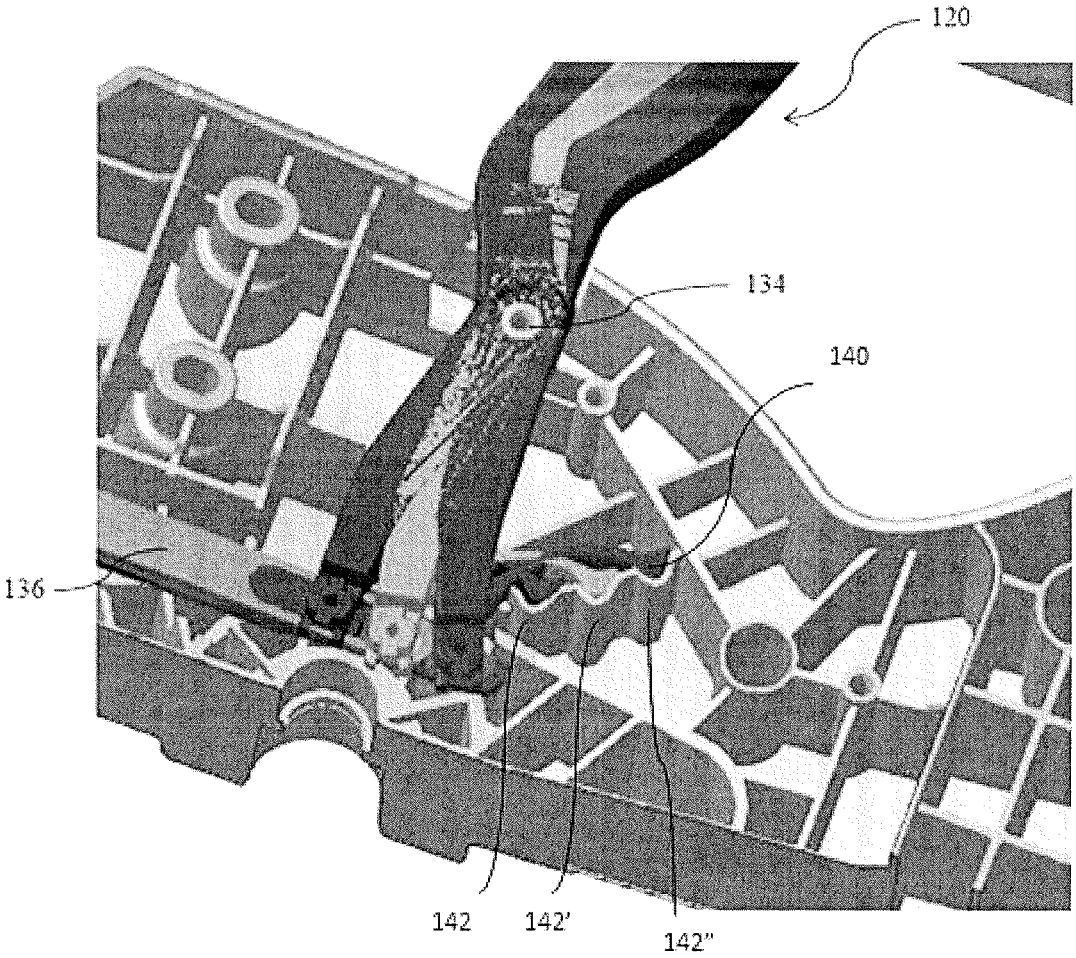
Figure 4C:
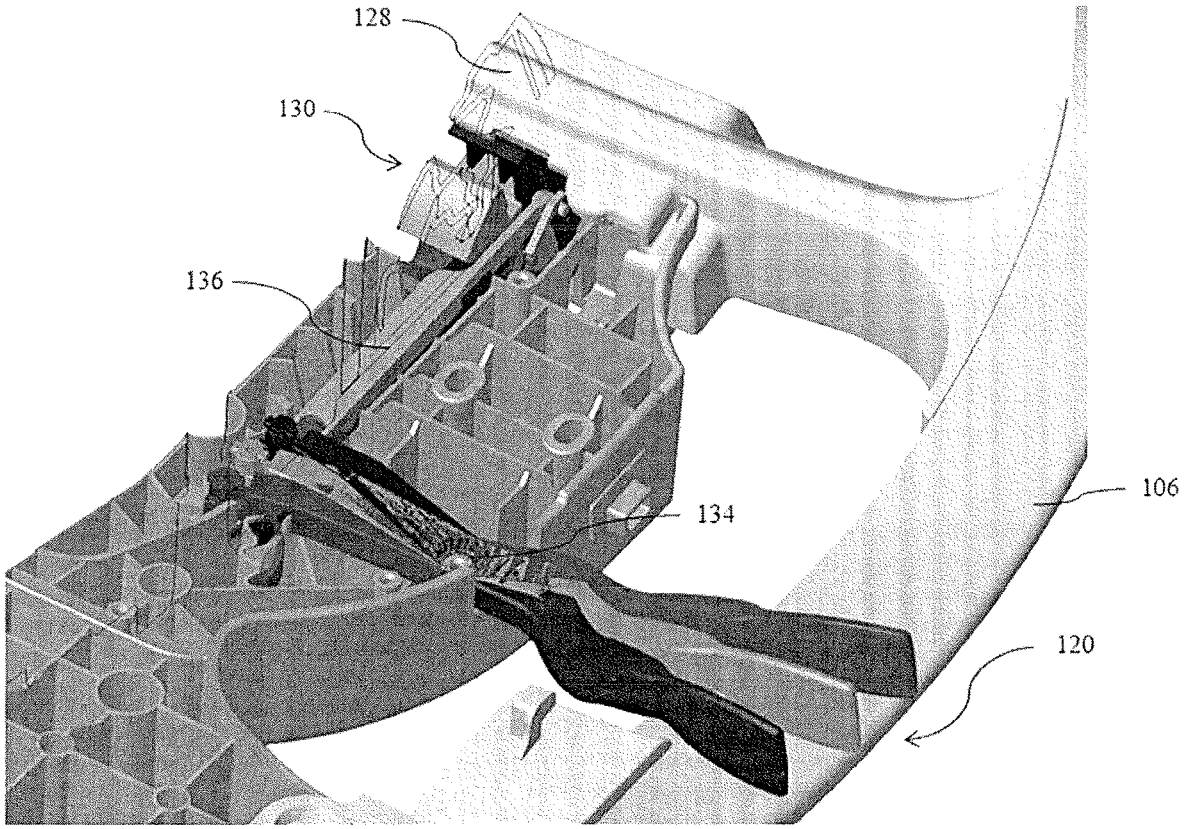
Figure 4D:
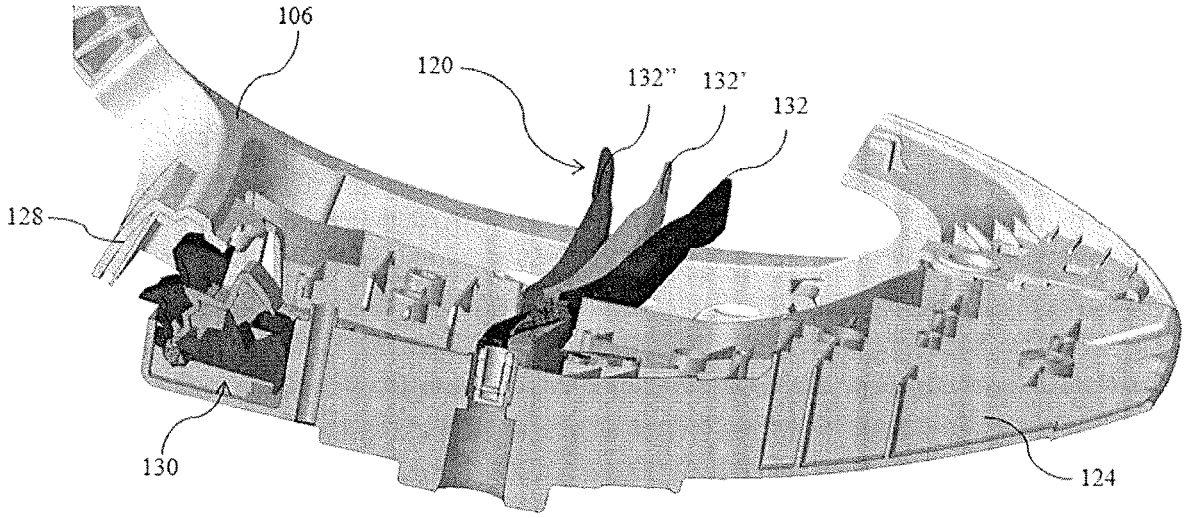

FIGS. 3*a* and 3*b* illustrate perspective views of back sub-assembly 104 and the two spine members 106 in accordance with an embodiment of the present subject matter. As can be seen from the figures, the spine members 106 is fixedly connected to a seat base sub-assembly 124 which is fixedly attached between the two spine members 106. The seat base sub-assembly 124 includes a plurality of box geometry with intersecting rib structure for strength. Further, curved portions of the spine members 106 include a plurality of organic shape slots/slits 126 for increasing flexibility of the spine members 106.

In an embodiment, the organic shape slots/slits 126 are flower-bud shaped for enhanced flexibility. Further, the spine members 106 comprise a combination blend of C-type and V-Type sections having continuous rib with cut-out in certain locations flexes through its geometry and plastic material properties. The plastic material is glass filled polyamide. However, the aforementioned plastic member is disclosed for exemplary purpose only and is not to be construed limiting in any way as any suitable material which shows similar plastic properties can be used to form the spine members 106. Further, the left hand and right hand spine members can move in differential motion (3-Dimensional) resulting in multi-axis movement.

FIGS. 4*a*, 4*b*, 4*c* and 4*d* illustrate structure and operation of a tilt limit lever 120 of the main chair 100 in accordance with an embodiment of the present subject matter. As can be seen in FIGS. 4*a* to 4*d*, the tilt limit lever 120 is moveably coupled to the seat base sub-assembly 124 such that a handle of the tilt limit lever 120 is accessible from the outer side of one of the spine members 106. The tilt limit lever 120 further comprises a tilt angle position snap 140 which engage with a tilt angle position slot 142 which is integral with the seat base sub-assembly 124. The two spine members 106 are connected to a rear part of the seat base sub-assembly 124 through a spine connector 128. The spine connector 128 aids in structural stability and forms an integral part of tilt limiting feature through resting on the backrest stopper 130 at multiple tilt angle positions. When the tilt limit lever 120 is operated through its handle to shift from a first position 132 (upright position) to a second position 132' (mid tilt position), the backrest stopper 130 rotates to stop the back-spine connector 128 at a particular position.

In an embodiment, the tilt limiter can be shifted to three different positions—a first position 132 (upright position), a second position 132' (mid tilt position) and a third position 132" (full tilt position) resulting in three different back tilt angles of the back sub-assembly 104. In first position 132, the tilt angle of the back sub-assembly is maintained at upright position without tilting which can also be called as no tilt position. Said position results in completely upright position of the back sub-assembly 104 and when a user pushes against the back sub-assembly 104, the back sub-assembly 104 flexes about a point of mating of the backrest stopper 130 and the back-spine connector 128. Similarly, the back rest portion can be adjusted in three tilt positions corresponding to the first position 132, the second position 132' and the third position 132" namely upright position, mid tilt position and the full tilt position.

In operation, when the tilt limit lever 120 is pushed to shift for example from the first position 132 to the second position 132', the tilt limit lever 120 moves radially about a pivot 134 of the tilt limit lever 120 and a tilt angle position snap 140 engages in one of tilt angle position slots (142, 142', 142") corresponding to the first position 132, to the second position 132' and to the third position 132" respectively thus achieving resistance and positive feedback between the multiple tilt limit settings. Upon the radial motion of the tilt limit lever 120, a tilt limit lever connector 136 which is connected to the backrest stopper 130 moves linearly. Further, the linear motion of the tilt limit lever connector 136 results into rotary motion of the backrest back stopper 130 which limits the back-spine connector 128 at a particular position.

In an embodiment, at the mid tilt position, the back sub-assembly 104 tilts up to a mid tilt position about the point where the spine member 106 is cantilevered from the front edge of the seat sub-assembly 102 and beyond that flexes about the point of mating of the backrest stopper 130 and the back-spine connector 128 when further pushed by the user. Similarly, in the full tilt position, the back sub-assembly 104 tilts to a full tilt position of the adjusting range about the point where the spine member 106 is cantilevered from the front edge of the seat sub-assembly 102 and beyond that flexes about the point of mating of the backrest stopper 130 and the back-spine connector 128 at a particular position.

Figure 5:
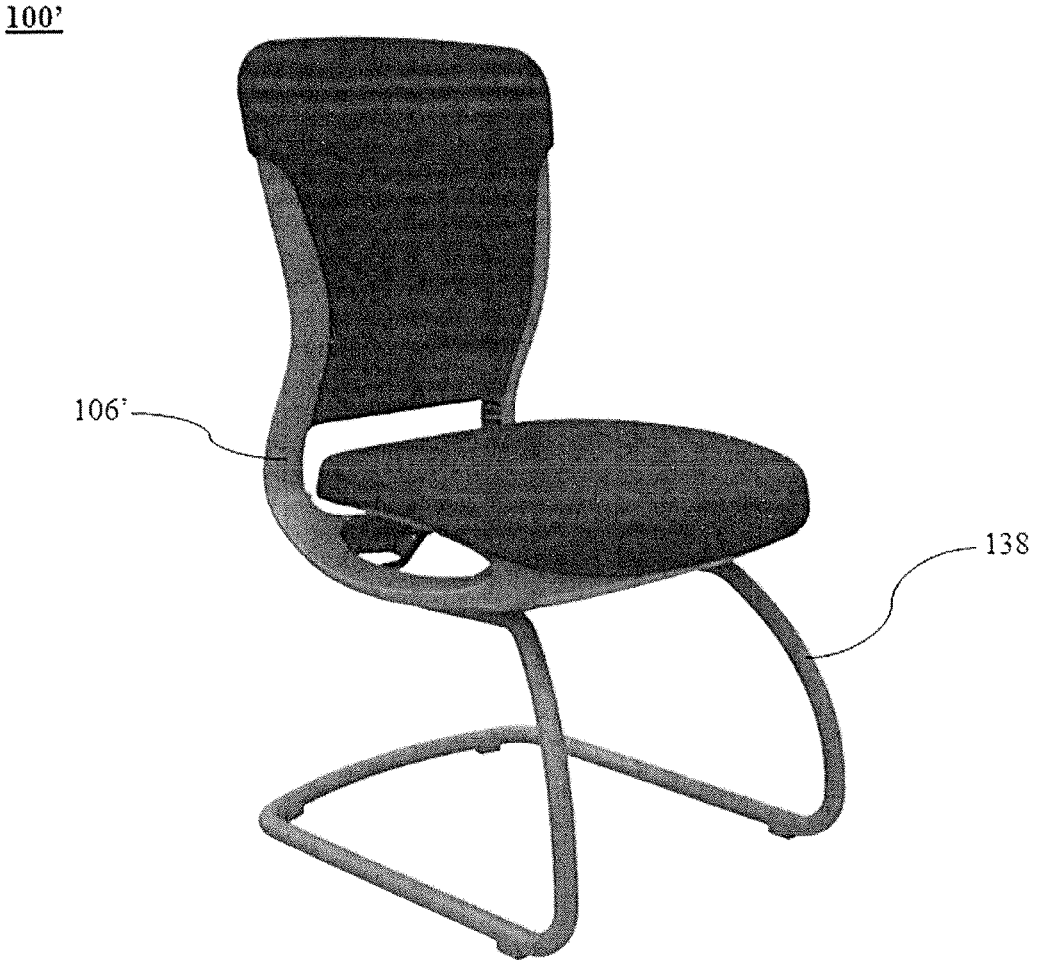
FIG. 5 illustrate a perspective view of a visitor chair in accordance with an embodiment of the present subject matter.

In an embodiment, as shown in FIG. 5, the visitor chair 100' comprises an visitor chair base frame structure 138 affixed with the spine members 106' to support the spine members 106', wherein the angular metal base 138 acts as an under-structure for the visitor chair 100'. The visitor chair 100 according to the present embodiment illustrates a simple aspect of the present invention and replicates upright position feature of main chair 100 as seen in the first position tilt limit position 132 having restricted tilting. The visitor chair 100' is simple, cost-effective version of the main chair 100 and is often used in visitor seating applications.

As can be seen from, the work chair is capable of assisting dynamic body movements, supporting posture efficiently and minimizing the risks associated with static positions.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit or scope of the present invention as defined.

We claim:

1. A posture adaptive work chair comprising:

a seat sub-assembly having a front edge and an opposing back edge, and a seat base sub-assembly between the front and back edges;

a pair of spine members cantilevered and extending from the front edge of the seat sub-assembly toward the opposing back edge of the seat-sub assembly;

a back sub-assembly located proximate to the opposing back edge of the seat sub-assembly and supported by the pair of spine members, the back sub-assembly being configured to synchronously flex in multiple axes based on a direction of load applied by a user; and a tilt limit lever movably coupled to the seat base sub-assembly, the tilt limit lever being configured to enable tilting of the back sub-assembly to a plurality of tilt positions.

2. The posture adaptive work chair as claimed in claim 1, wherein the pair of cantilevered spine members is fixedly connected to a rear part of the seat base subassembly through a spine connector, the spine connector being configured to facilitate tilting of the back sub-assembly to the plurality of tilt positions.

3. The posture adaptive work chair as claimed in claim 2, wherein each of the spine members comprises:

a curved portion having a plurality of slots to increase flexibility of each of the spine members; and a spine member section having cut-outs enabling multi-directional flexing of the spine member, wherein the slots in the spine member section acting as flexion stoppers during the tilting.

4. The posture adaptive work chair as claimed in claim 1, wherein at least one adjustable armrest sub-assembly is disposed on each lateral opposite side of the seat sub-assembly to support arms of the user in sitting position; and the at least one adjustable armrest sub-assembly is configured such that by operating a push button a height of the at least one adjustable armrest sub-assembly is adjusted in a longitudinal direction.

5. The posture adaptive work chair as claimed in claim 1, wherein a pedestal base member is fixedly connected to the base seat sub-assembly; and the pedestal base member comprises a plurality of castors rotatably attached at a bottom portion of the pedestal base member in order to displace the work chair from one place to another.

6. The posture adaptive work chair as claimed in claim 5, wherein a telescopic gas-lift cylinder is fixedly attached between the pedestal base member and the base seat sub-assembly; and the telescopic gas-lift cylinder is actuated by operating a seat adjustment lever to adjust a height of the work chair.

7. The posture adaptive work chair as claimed in claim 1, wherein the tilt limit lever comprises a tilt angle position snap configured to engage with at least one tilt angle position slot for each tilt position, when the tilt limit lever moves radially about a pivot of the tilt limit lever.

8. The posture adaptive work chair as claimed in claim 7, wherein the tilt limit lever is movably connected to a tilt lever connector so that radial movement of the tilt limit lever results in linear motion of the tilt lever connector.

9. The posture adaptive work chair as claimed in claim 8, wherein the tilt lever connector is rotatably connected to a backrest stopper so that linear motion of the tilt lever connector results in rotary motion of the backrest stopper being configured to engage with a back-spine connector at each tilt position.

10. The posture adaptive work chair as claimed in claim 1, wherein each tilt position is carried out by the user operating the tilt limit lever or applying load on the back sub-assembly to achieve different tilt positions of the back sub-assembly.

11. A visitor chair comprising a base frame structure fixedly attached to the pair of spine members as claimed in claim 1, wherein the pair of spine members supports the back sub-assembly being tilted in a first position.

12. The posture adaptive work chair as claimed in claim 1, wherein the pair of spine members extends beyond the opposing back edge of the seat-sub assembly.

* * * * *